United States Patent [19]

Tolliver

[11] 4,079,500

[45] Mar. 21, 1978

[54] METHOD OF MAKING REINFORCED CONCRETE PIPE

[75] Inventor: Wilbur E. Tolliver, 364 Hamilton Dr., Holland, Mich. 49423

[73] Assignee: Wilbur E. Tolliver, Holland, Mich.

[21] Appl. No.: 633,810

[22] Filed: Nov. 20, 1975

[51] Int. Cl.[2] ..... B28B 21/64; B28B 21/30

[52] U.S. Cl. ..... 29/460; 140/3 R; 140/3 C; 245/2; 140/107; 245/8; 264/259; 264/267; 264/274; 264/279; 264/299; 264/309; 264/311; 264/312; 264/333

[58] Field of Search ..... 264/33, 34, 309, 333, 264/228, 229, 259, 312, 35, 270, 311, 258, 279, 278, 299, 267, 274; 138/175, 176; 52/245, 653, 648, 741; 256/45; 140/107; 245/2, 8; 29/460

[56] References Cited

U.S. PATENT DOCUMENTS

| | | | |
|---|---|---|---|
| 782,877 | 2/1905 | Roney | 256/45 |
| 1,058,274 | 4/1913 | Tirapani | 256/45 |
| 1,326,594 | 12/1919 | Hume | 138/176 |
| 1,895,740 | 1/1933 | Ukropina | 264/270 |
| 3,162,709 | 12/1964 | Davidson | 138/170 |

*Primary Examiner*—Willard E. Hoag

*Attorney, Agent, or Firm*—Price, Heneveld, Huizenga & Cooper

[57] ABSTRACT

Method of reinforcing concrete pipe in a rotary molding method using a wire reinforcing cage having a helical strand disposed about its exterior to resist torsional forces on the cage during molding, the cage being formed from a flat sheet.

8 Claims, 10 Drawing Figures

METHOD OF MAKING REINFORCED CONCRETE PIPE

BACKGROUND OF THE INVENTION

The present invention relates to welded wire fabric for use particularly in making cylindrical reinforcing cages for reinforcing concrete pipe. It is particularly advantageous for use in conjunction with packer head type pipe manufacturing machines and similar machines which impart a torsional force to a reinforcing cage as concrete is formed around it.

Packer head type pipe making machines are the most commonly used pipe manufacturing equipment for small diameter concrete pipe. Basically, the manufacturer first inserts a cylindrical reinforcing cage into the cylindrical pipe form. The roller head is then inserted all the way to the bottom of the form. The head is then activated to simultaneously inject concrete into the form, rotate and move gradually upwardly towards the top of the form. The rotating head is gradually moved upwardly as it is rotated and as concrete is cast around the reinforcing cage until the pipe has been completed and the rotating head is drawn out of the top of the form.

One quality control problem which is encountered in manufacturing pipe in this manner is that once the bottom of the cage is embedded in concrete, there is a tendency for the cage to twist as the packer head continues to rotate and move upwardly. The rotating packer head and the movement of concrete applies a substantial torsional force on the cage. The problems created are twofold. First, the twisting tends to bring the cage too close to the inside wall of the pipe or possibly at points too close to the outside wall of the pipe if the cage gets skewed by the twisting action. Sometimes, fabric actually sticks through the pipe wall, in which case the pipe has to be rejected at the outset.

A second problem which is somewhat more insidious in nature is that the twisting of the cage sets up built in stresses within the wall of the pipe, even if the cage does not actually project through the inside or outside wall surface. In other words, even after the pipe is formed, the cage inside is trying to twist back to its original shape, thereby placing stresses on the concrete walls which can lead to cracking or comparable decay of the pipe before or during curing.

Heretofore, the first problem discussed above is often blamed on improper formation of the cage, rather than on torsional twisting of the cage during manufacture of the pipe. Artisans have attempted to solve the second and more insidious problem by either making two passes with the packer head, one clockwise and the other counterclockwise, or by placing centering arms on the packer head shaft housing above the roller head. The ends of these arms engage the cage and slide up it as the roller head moves up.

SUMMARY OF THE INVENTION

In the present invention, otherwise conventional fabric having a plurality of perpendicularly oriented strands of interconnected wire is equipped with diagonal reinforcing means extending diagonally with respect to the conventionally oriented wires. This fabric can be cut into sections which are formed into cylindrical cages in such a way that the spiral defined by the diagonal reinforcing means is generated from the bottom to the top of the cage in the direction of rotation in which the packer or roller head is to be operated. The formed cage is then placed into the packer head machine and the packer head is rotated in the appropriate direction. The diagonal reinforcing means resists the tendency for the cage to be twisted by the rotation of the packer head and the movement of concrete resulting therefrom.

BRIEF DESCRIPTION OF THE DRAWINGS

The above concept as well as other features, objects and advantages of the invention will be more fully understood and appreciated by reference to the written specification and appended drawings in which.

DESCRIPTION OF THE PREFERRED EMBODIMENT

Figure 1:
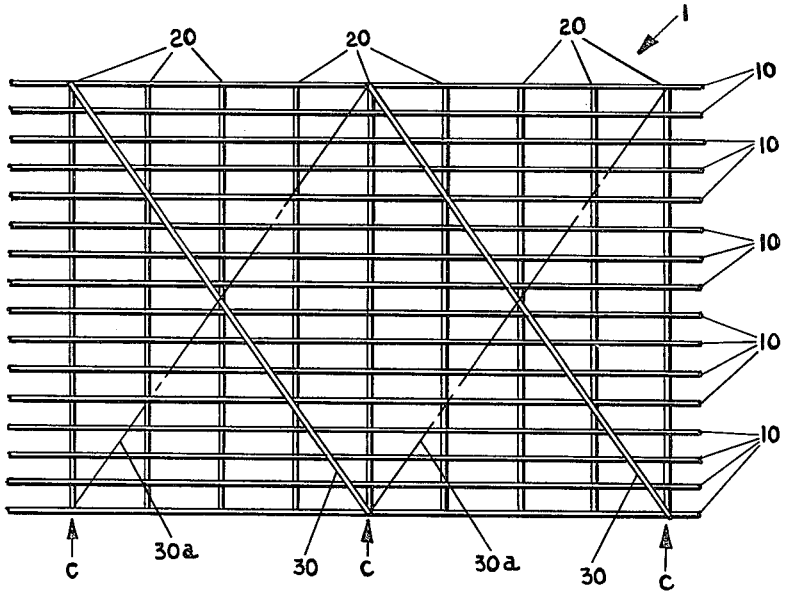
FIG. 1 is a plan view of fabric made in accordance with the present invention.

Referring to FIG. 1, it can be seen that the fabric 1 includes a plurality of so-called line or longitudinal wires 10 and a plurality of transverse wires 20. When a fabric segment is cut from fabric 1 and formed into a cylindrical cage, the line or longitudinal wires 10 of the fabric will become the circumferential wires of the cage. Accordingly, the wires which the fabric manufacturer typically refers to as line or longitudinal wires will be referred to herein as circumferential defining wires, since they define the circumferential wires in a formed cage. The transverse wires 20 will become the longitudinal wires of a formed cage and accordingly are referred to herein as longitudinal defining wires. As is conventional the circumferential defining wires run parallel to one another and parallel to one axis of fabric 1 while the longitudinal defining wires run parallel to each other, perpendicular to the circumferential defining wires and parallel to the other axis of the fabric 1. As is also conventional, the circumferential defining strands and the longitudinal defining strands are rigidly interconnected by welding.

Extending diagonally across the circumferential defining strands 10 and longitudinal defining strand 20 are a plurality of diagonal reinforcing strands of wire 30.

Each diagonal wire 30 is oriented at an angle of between approximately 30° and 60° with respect to the longitudinal or circumferential defining wires. Specifically, in the FIG. 1 fabric, the diagonal reinforcing wires 30 are oriented at approximately 60° with respect to the circumferential defining strands 10. Preferably, each diagonal reinforcing strand 30 extends from one side of the fabric to the other (from the bottom to the top of the fabric as viewed in FIG. 1 and as viewed when a section of fabric is cut and rolled into a cage) and is welded at a plurality of points to either the circumferential defining strands 10 or the longitudinal defining strands 20 depending on which side of the fabric the diagonal wires 30 are laid on.

Figure 2:
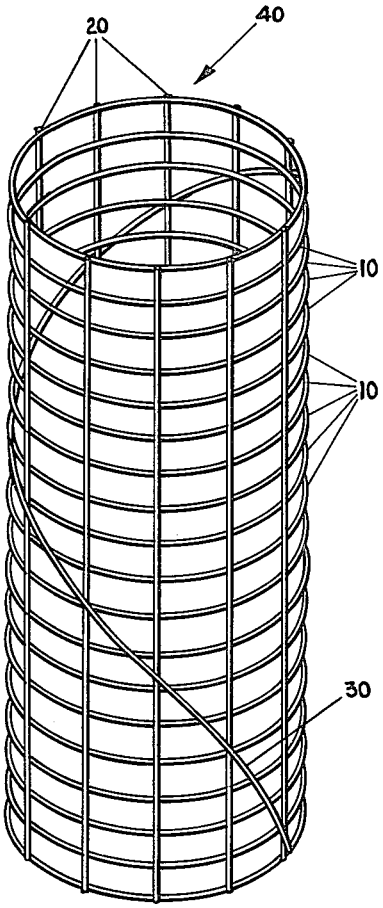
FIG. 2 is a perspective view of a cylindrical cage formed from the fabric shown in FIG. 1.

The fabric shown in FIG. 1 is designed to be cut at the arrows C. Essentially then, one diagonal reinforcing wire 30 will extend generally from the bottom to the top of each fabric segment which is to be formed into a cylindrical cage. (The points C at which the wire is sheared may be varied somewhat in actual practice depending on the amount of overlap which the manufacturer wants his cage to have.) When the resulting fabric segment is then formed into a cylindrical cage, it will have the appearance generally as shown in FIG. 2. The diagonal reinforcing strand 30 will define a spiral generated in a clockwise direction as one proceeds from the bottom to the top of the cage 40 which is shown in FIG. 2. The diagonal strand 30 is made basically of the same type of wire which is used for the longitudinal and circumferential defining strands of the fabric, such wire being well known in the industry. Examples include wire conforming to the Specifications for Cold-Drawn Steel Wire for Concrete Reinforcement (ASTM Designation: A 82), or the Specification for Deformed Steel Wire for Concrete Reinforcement (ASTM Designation: A 496), or of wire fabric conforming to the Specifications for Welded Steel Wire Fabric for Concrete Reinforcement (ASTM Designation: A 185), or the Specification for Welded Deformed Steel Wire Fabric for Concrete Reinforcement (ASTM Designation: A 497).

Figure 3:
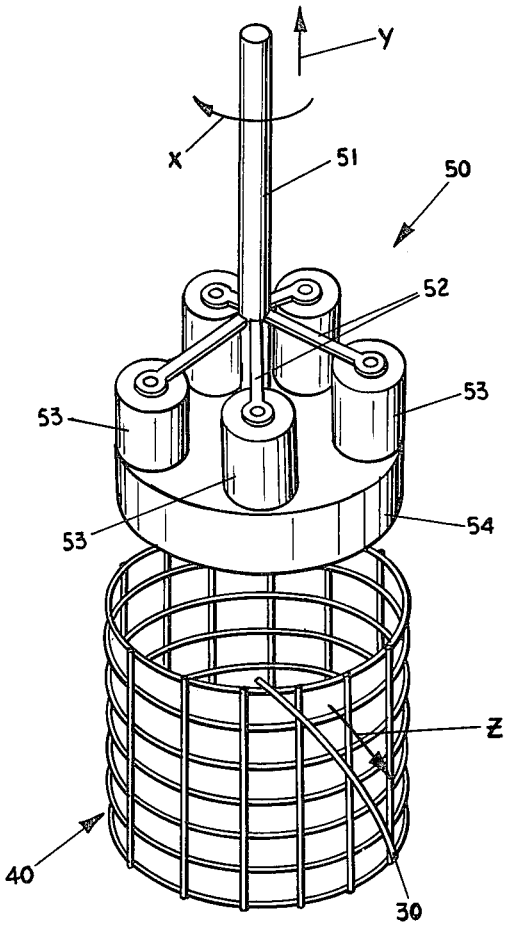
FIG. 3 is a schematic view illustrating the direction of movement of the rotating head and the action of the opposing force of the diagonal reinforcing means.

It is important that the spiral defined by diagonal reinforcing strand 30 when the fabric is formed into a cage 40 be generated, as one proceeds from the bottom to the top of cage 40, in the same direction in which the rotating head 50 is to rotate (See FIG. 3). In FIG. 3, the rotating head 50 is set for rotation in a clockwise direction. Rotating heads can also typically rotate in a counterclockwise direction. In that case, the diagonal strands 30 would be laid in the opposite direction to that shown in FIG. 1, and a possible position for them is indicated by the phantom lines 30*a* shown in FIG. 1.

Some pipe manufacturers make two passes with their packer head machines in a single pipe, a first in a clockwise and a second in a counterclockwise direction (or vice versa). In this case, it is most important that the diagonal strand 30 be oriented so that its spiral is generated from the bottom to the top of cage 40 in the same direction which the packer head is to be rotated on its first pass. Once the pipe has been cast and packed in a first pass, it is not as important that there be diagonal reinforcement oriented in the opposite direction for the second pass during which the packer head 50 is rotated in the opposite direction. Indeed, the present invention may eliminate the necessity for using the packer head in a second pass. In any event, one can optionally include diagonal reinforcing strands running in both directions to accommodate the fact that the packer head is used in two passes in opposite directions of rotation. Thus, one might have fabric with diagonal reinforcing strands 30 running as shown in FIG. 1 and with diagonal reinforcing strands running in the opposite direction as indicated by the phantom lines 30*a*.

The effect of the forces generated by packer head 50 and the resisting forces generated in diagonal reinforcing strand 30 are illustrated in FIG. 3. Packer head 50 includes a rotating shaft 51, a bottom skirt or trowel 54 and a plurality of rollers 53 mounted on the top plate of the trowel 54 and supported by some type of mounting arms 52. The direction of rotation of packer head 50 in this illustration is clockwise as indicated by the arrow X. In addition, as packer head 50 is rotated, it is moved upwardly as indicated by the arrow Y. The resultant torsional force on a cage 40 will be opposed by the diagonal reinforcing strand 30 in the manner indicated by the arrow Z. In this way, torsional twisting of cage 40 during formation of the pipe therearound is eliminated or at least substantially minimized.

Figure 4:
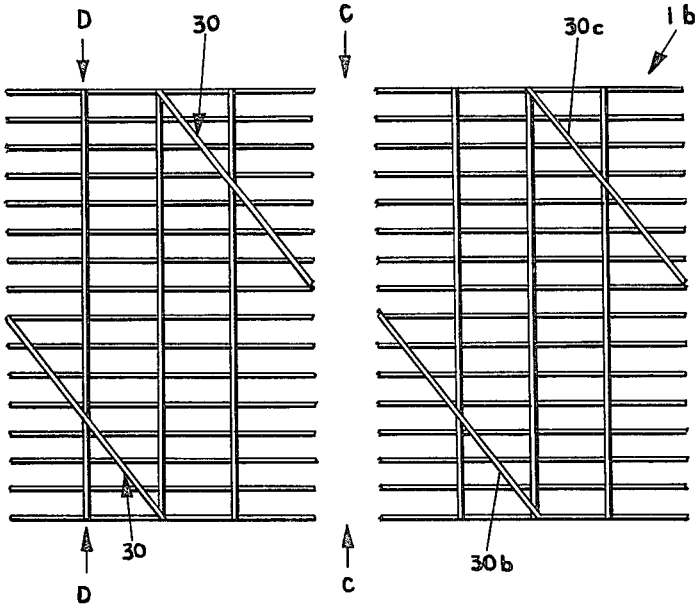
FIG. 4 is a plan view of the FIG. 1 fabric cut at a different location than directly at the ends of the diagonal reinforcing wires.
Figure 5:
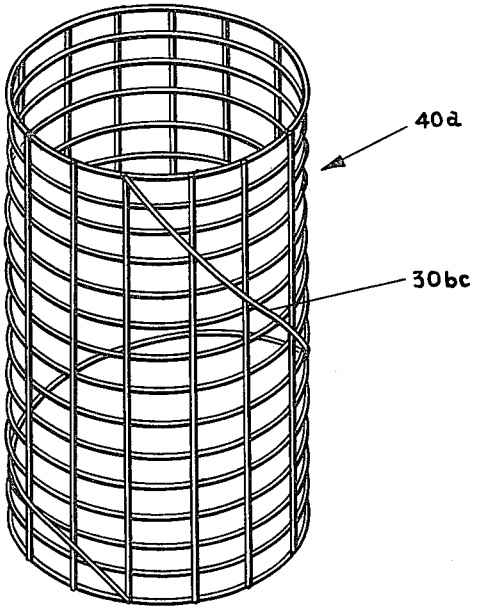
FIG. 5 is a perspective view showing a cage formed from fabric segments cut as shown in FIG. 4.

In the fabric as shown in FIG. 1, the fabric is laid out and designed to be cut in such a way that a diagonal reinforcing strand 30 extends continuously generally from the bottom to the top of each fabric segment. It is not essential that the fabric be cut in this manner. Thus, the fabric could be cut as indicated by the arrow C in FIG. 4. When a fabric segment as shown in FIG. 4 is formed into a cylindrical cage 40*a*, cage 40*a* will have the appearance of the cage shown in FIG. 5. In other words, the end of one cut section of diagonal reinforcing wire 30*b* will in essence match up or fairly closely match up to the opposite end of the cut segment of the upper diagonal reinforcing strand 30*c* to create in the final cage a generally continuous strand 30*bc*.

It is not essential even that the ends of the cut segments of diagonal reinforcing strands 30 match up, although such matching is preferable. It is also preferable that diagonal reinforcing means extend generally from the bottom to the top of a cage 40, regardless of whether the ends of different pieces of diagonal reinforcing 30 match up or abut. In other words, it is important that there be diagonal reinforcing at each level of a cage 40 as one proceeds generally from the bottom towards the top thereof. Referring to FIG. 4, it would not be desirable to design the fabric as shown in FIG. 4 for a cage to be made from a fabric segment cut at arrow D as well as at arrow C shown therein. It can be seen that such a design would leave the entire middle section of a cage formed from such a fabric segment without diagonal reinforcing, (note the shaded section of the fabric segment shown in FIG. 4 between the arrows C and D).

Figure 7:
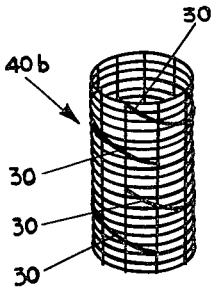
FIG. 7 is a perspective view of a cage made formed of the FIG. 6 fabrics.
Figure 6:
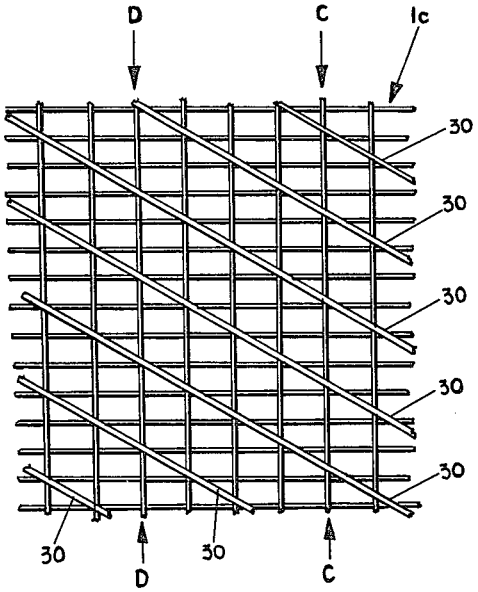
FIG. 6 is a plan view of an alternative fabric to that disclosed in FIG. 1 in which the diagonal reinforcing strands are oriented at a lower angle and are oriented in overlapping fashion.

If a pipe manufacturer needed fabric segments as narrow as the C–D segment for purposes of forming a cage, he would have to be sure that the pitch or frequency of the diagonal reinforcing strands 30 was at least one greater per length equal to the length C–D. Such fabric is shown in FIG. 6 in which the diagonal reinforcing strands 30 are so frequent they overlap one another, in the sense that more than one strand 30 crosses a given vertical section of the fabric as viewed in FIG. 6. To illustrate possible variations in slope, the strands 30 of fabric 1*c* are also oriented at approximately 30°. It can be seen that when the fabric 1*c* of FIG. 6 is cut at the arrows C and D and formed into a cage, the various pieces of diagonal reinforcing strands 30 will not butt end to end and form a continual spiral. However, the ends of each of the spiral segments defined by the diagonal wires 30 will overlap one another as shown in FIG. 7. In other words, the diagonal reinforcing when considered as a means in its entirety, is generally coextensive with the height of the cage, or in other words is operably continuous from the bottom of the cage 40*b* shown in FIG. 7, even though there is no single continuous spiral strand of diagonal reinforcing wire 30. No horizontal segment of the cage is without a portion of a diagonal reinforcing strand 30 extending therethrough.

Just as it is preferable for the diagonal reinforcing means as an entirety to be generally operably coextensive with the height of each cage forming segment, it is also desirable that the diagonal reinforcing means be generally operably coextensive with the width of each cage forming segment. The pitch of individual strands 30 should be sufficiently great that even if the strands do not overlap, one starts at a point vertically aligned with the point at which the succeeding strand leaves off.

Particularly in the case of convoluted bell end fabric, where the bell end of the fabric can be expanded outwardly after a cage is formed, a manufacturer may not want to have the diagonal reinforcing strand 30 extend into the area occupied by the two or three bell forming convoluted strands. The diagonal 30 would interfere with the expansion of these convolutes. Still, as used in this specification, the diagonal would extend generally from the top to bottom of the fabric cage and would be operably continuous over that general range even though the end two or three wires would not be encompassed. This is particularly apt terminology since the bell end of the pipe is typically formed by a vibrator at the bottom of the packer head apparatus and it is not formed by the rotating head 50 itself. Head 50 forms the walls above the bell of the pipe.

Figure 8:
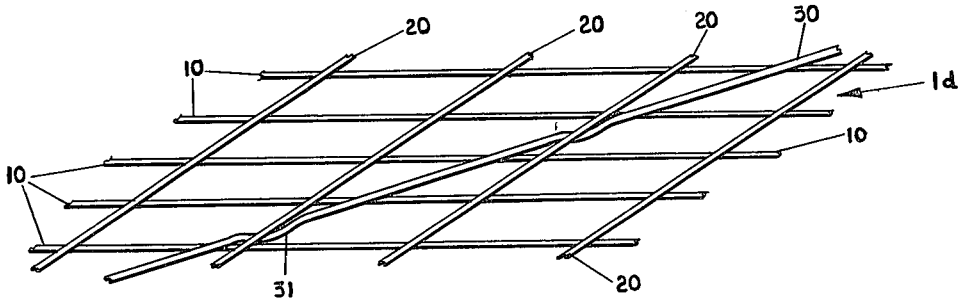
FIG. 8 is a perspective view of an alternative embodiment fabric in which the diagonal reinforcing means are woven.

In the embodiment of fabric 1*d* shown in FIG. 8, each diagonal reinforcing strand 30 is in essence woven through the various circumferential defining strands 10 and the longitudinal defining strands 20. Each diagonal reinforcing strand 30 lies basically in the plane of the longitudinal defining strands 20 of the fabric 1*d*. However, each diagonal strand 30 includes a deviation 31 therein which enables the strand 30 to deviate beneath the longitudinal defining strands 20 and into the plane of the strands 10 as it crosses the strands 20. The deviating portion 31 lies generally in the plane defined by the circumferential defining strands 10. In this way, the addition of the diagonal reinforcing strands 30 does not increase the thickness of the fabric as a whole, but leaves it only as thick as conventional fabric would be.

Figure 9:
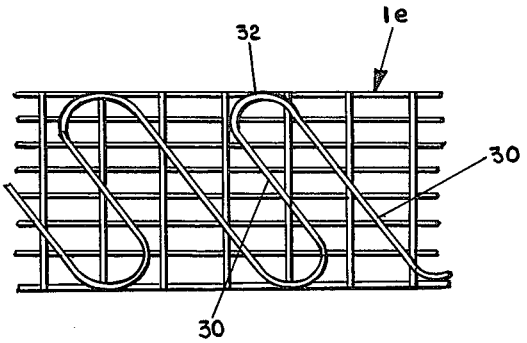
FIG. 9 is a plan view of an alternative embodiment fabric in which the diagonal reinforcing means are formed of a single, continuous strand of wire.

Yet another alternative embodiment, fabric 1*e* is shown in FIG. 9. In the FIG. 9 fabric, a first diagonal reinforcing strand 30 is defined by a continuous strand extending generally from the bottom edge of the fabric to the top edge and then curving back through a curved portion 32 to define another diagonal strand 30 extending generally parallel to the first. This pattern is then repeated throughout the length of the fabric. For some types of manufacturing operations, it may be easier to add the diagonal reinforcing strands 30 by way of a single continuous strand rather than by way of adding separate lengths.

Figure 10:
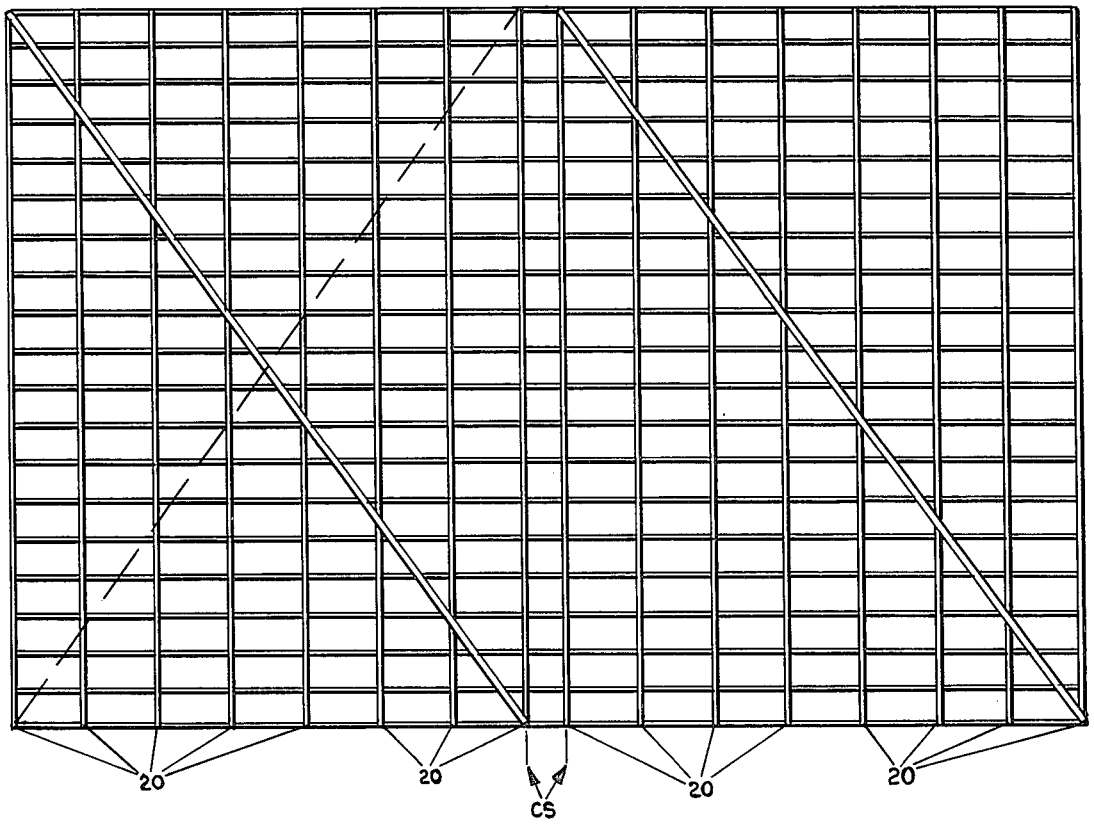
FIG. 10 is a plan view of an alternative embodiment fabric in which a single diagonal reinforcing strand is provided for each set of transverse strands, where each set has a particular predetermined length for a particular purpose.

The present invention is particularly useful in conjunction with fabric such as that disclosed in Ser. No. 542,410, entitled "METHOD AND FABRIC FOR MAKING REINFORCING CAGES", filed on Jan. 20, 1975, by Wilbur E. Tolliver and Daniel J. Borodin, and assigned to New York Wire Mills Corporation. The application of this invention to such fabric is illustrated in FIG. 10. FIG. 10 shows fabric having a plurality of sets of transverse or longitudinal defining strands 20, with the adjacent first and last strands in adjacent sets being separated by a smaller cutting space "CS". Each set of strands 20 has a length which will form a cage or reinforcing mat of a particular predetermined desired diameter and circumference. A single diagonal reinforcing strand 30 is provided across each set of transverse strands 20.

Of course, it is understood that the above is merely a preferred embodiment of the invention and that various changes and alterations can be made without departing from the spirit and broader aspects of the invention.

The embodiments of the invention in which an exclusive property or privilege is claimed are defined as follows.

1. In a method for forming concrete pipe by injecting concrete into a form containing a wire reinforcing cage, using a rotary concrete aggregate injecting head, the improvement comprising:

forming a wire fabric sheet having substantially parallel longitudinal and transverse wires, said longitudinal and transverse wires being substantially perpendicular to each other, said forming also including securing diagonal reinforcement at a plurality of points to at least one of a plurality of said longitudinal and transverse wires, said diagonal reinforcement extending from one edge of said fabric to an opposite edge thereof, forming said fabric into a cylindrical cage so that said diagonal reinforcement extends generally spirally about said cage, running from one end thereof to the other, inserting said cage in a cylindrical form and inserting a rotary concrete aggregate depositing head within said form through a first end of said cage; and beginning adjacent a second end of said cage injecting said aggregate through said head into said form during a first injecting pass of said head while slowly withdrawing said head from said form and while rotating said head in the same rotational direction that said spiral is generated about said cage from said second end of said cage to said first end.

2. The method of claim 1 wherein said transverse wires lie in a common plane when said fabric is flat and said longitudinal wires lie in a common plane adjacent thereto; said diagonal reinforcement comprises at least one strand of reinforcing material lying generally in the plane of one of said transverse and longitudinal wires, and including deviations out of said plane and into the plane of the other of said longitudinal and transverse wires at those points where said one strand of reinforcing material crosses wires in said one of said longitudinal and transverse wires.

3. The method of claim 1 in which said diagonal reinforcement comprises a plurality of strands of reinforcing material.

4. The method of claim 1 in which said diagonal reinforcement comprises a continuous strand of reinforcing material extending from one edge of said fabric to the other and then curving back the other way again and so continuing to define a plurality of generally parallel diagonal reinforcing strand portions joined by curved strand portions.

5. The method of claim 1 in which said diagonal reinforcement is generally operably coextensive with both the height and width of a section of said fabric which is to form a cage.

6. The method of claim 5 in which said diagonal reinforcement comprises a plurality of strands of reinforcing material.

7. The method of claim 1 in which said diagonal reinforcement is oriented at an angle of between thirty and sixty degrees with respect to one of said sets of circumferential defining and longitudinal defining strands.

8. The method of claim 7 in which said diagonal reinforcement comprises at least one strand of reinforcing wire.

* * * * *